United States Patent [19]

Sorensen

[11] Patent Number: 4,671,416

[45] Date of Patent: Jun. 9, 1987

[54] EYEGLASS MERCHANDIZING DISPLAY

[75] Inventor: Gerald R. Sorensen, Elgin, Ill.

[73] Assignee: NCM International, Inc., Arlington Heights, Ill.

[21] Appl. No.: 909,001

[22] Filed: Sep. 18, 1986

[51] Int. Cl.[4] ..... A47F 7/02

[52] U.S. Cl. ..... 211/13; 248/DIG. 2

[58] Field of Search ..... 211/13, 163, 87; 248/DIG. 2

[56] References Cited

U.S. PATENT DOCUMENTS

| | | | |
|---|---|---|---|
| 1,492,113 | 11/1923 | Welsh . | |
| 2,764,286 | 9/1956 | Carmichael . | |
| 3,090,491 | 5/1963 | Bohr | 211/40 |
| 3,858,726 | 1/1975 | Rosenwein . | |
| 3,884,357 | 5/1975 | Bloch . | |
| 4,084,700 | 4/1978 | Dunchock . | |
| 4,211,331 | 1/1980 | Salmon et al. . | |

*Primary Examiner*—Robert W. Gibson, Jr.

*Attorney, Agent, or Firm*—Wallenstein, Wagner, Hattis, Strampel & Aubel, Ltd.

[57] ABSTRACT

An improved eyeglass merchandizing display eliminating use of display panel openings for supporting pairs of eyeglasses comprising a vertical panel having a planar display surface. Integrally formed on the display surface are aligned pairs of eyeglass holding members including a base leg projecting from the display surface and a support leg angularly joined to the base leg. The support leg angling inward to the display surface and preferably the base leg angling slightly upward toward the top of the panel to snuggly carry eyeglasses on the support members and displaying said eyeglasses in a position parallel to the display surface.

4 Claims, 7 Drawing Figures

EYEGLASS MERCHANDIZING DISPLAY

TECHNICAL FIELD OF THE INVENTION

The present invention generally relates to retail merchandising displays and in particular to an improved display for displaying eyeglasses, sunglasses and frames therefor.

BACKGROUND OF THE INVENTION

Merchandising displays for eyeglasses and eyeglass frames find many uses in the marketplace for retailing prescription and nonprescription sunglasses, eyeglasses as well as frames. The prior art discloses numerous eyeglass merchandising displays including U.S. Pat. Nos. 4,211,331; 3,884,357; 3,858,726, 2,764,286 and 1.492,113. The structure of prior art eyeglass merchandising displays typically requires passing the temple and earpiece portions of the eyeglass frame through apertures in the display as a means of carrying the eyeglass frame on the display. As a result, removal of the eyeglass frame from the display and its later replacement is cumbersome. Because of the difficulty of properly replacing eyeglass frames on the display after consumer examination, eyeglasses are often haphazardly returned to the display. In a short time eyeglasses on the display become in disarray leading to an unattractive merchandising display and requiring continuous maintenance by retail personnel.

Further, because prior art eyeglass displays utilized such display panel apertures, these displays are typically deeper and bulkier to accommodate the earpiece and temple portions of the eyeglass protruding on the backside of the display. As a result, many such prior art displays are not readily adaptable for use as wall mount or countertop displays. Rather, the prior art eyeglass displays are typically limited to use on free-standing kiosk displays.

Further, by utilizing display panel apertures as a means of securing eyeglasses to the display, the eyeglasses must be arranged on the display in vertical columns to prevent eyeglasses from slipping out of the display. The vertical arrangement of eyeglass frames on the display limits the various styles and sizes of eyeglasses which can be carried on the display unless the overall dimensions of the display are greatly increased.

While U.S. Pat. No. 4,084,700 suggests the use of L-shaped support tabs integrally formed with a display panel for displaying eyeglass lenses, no reference has been discovered to adapt this broad concept for use in displaying eyeglasses and eyeglass frames.

Hence, prior to the development of the present invention, a need existed for an attractive eyeglass merchandising display which eliminates the use of display panel apertures and yet allows consumers to easily remove and neatly replace eyeglass frames on the display. Such a display would enhance the merchandising of the eyeglasses and require less display maintenance than prior art displays.

A further need existed for an eyeglass merchandising display which would allow for an angular or skewed arrangement of eyeglass frames on the display to maximize the number of different sizes and styles of eyeglasses carried on the display while minimizing the overall dimensions of the display itself.

Finally, a need existed for an eyeglass display having all of the above properties, yet being readily adaptable for countertop and wall mount use as well as in free-standing displays.

SUMMARY OF THE INVENTION

According to the present invention, an improved eyeglass merchandising display has been developed which unlike prior art displays, eliminates the use of display panel apertures to receive portions of the eyeglass frame temples and earpieces as a means of carrying the eyeglasses on the display. Rather, the present invention utilizes uniquely configured support members allowing for the easy removal and replacement of eyeglasses. In addition, the eyeglass display of the present invention allows for the angular arrangement of a plurality of eyeglasses on the display, thereby allowing for the display of eyeglasses or frames of differing sizes, styles and configurations, yet minimizing the overall dimensions of the display panel.

Further, by eliminating display panel apertures for carrying the eyeglass frames, the present invention carries the eyeglasses on the front face of a display panel. As a result, the present eyeglass display has minimal depth dimensions allowing the display to be wall mounted, or in a smaller form, used as a countertop or point of purchase display in addition to use in a free-standing kiosk-style commonly known in the art.

Generally, the eyeglass display of the present invention includes a vertical display panel having a generally planar display surface. Integrally formed with the panel and projecting from the plane of the display surface are at least two aligned eyeglass holding members for carrying one eyeglass on the display surface. Each holding member comprises a base leg projecting from the panel display surface and a support leg joined to the base leg. In a broad form of the present invention, the support leg angles inward toward the plane of the display surface. In a preferred form of the present invention, the base leg is inwardly inclined on the panel display surface together with the inward angling of the support leg.

The eyeglass display of the present invention carries eyeglasses and eyeglass frames in a folded position parallel to and in front of the panel display surface by resting hinge and temple portions of the eyeglasses on various supportive surfaces of the eyeglass holding members. Finally, a plurality of pairs of eyeglass holding members may be angularly oriented on the display surface of the vertical panel to accommodate a wide variety of eyeglass frames of differing sizes and configurations yet minimizing the overall dimensions of the display panel.

Other advantages and aspects of the invention will become apparent upon making reference to the specification, claims, and drawings to follow.

DETAILED DESCRIPTION OF THE INVENTION

Figure 1:
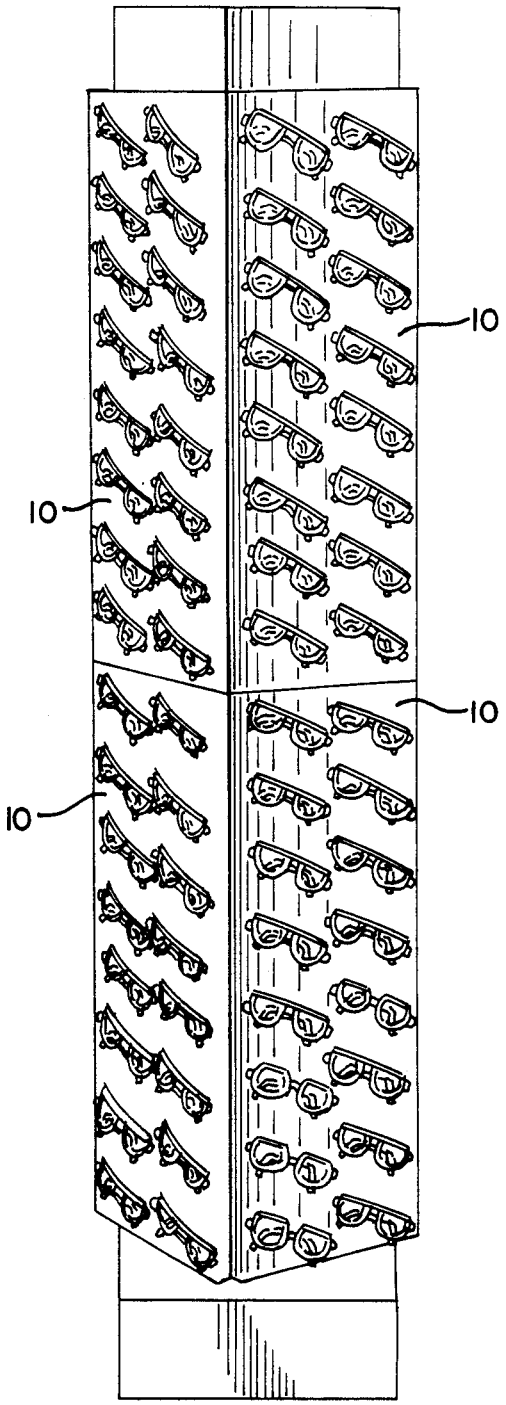
FIG. 1 is a perspective view of one embodiment of use of the eyeglass display panels of the present invention.

Referring now to the drawings, FIG. 1 discloses a revolving kiosk-style eyeglass merchandising display showing use of a preferred embodiment of display panels 10 of the present invention. It should be understood that the term "eyeglass" as used herein generically refers to prescription and non-prescription eyeglasses, sunglasses as well as frames.

Figure 2:
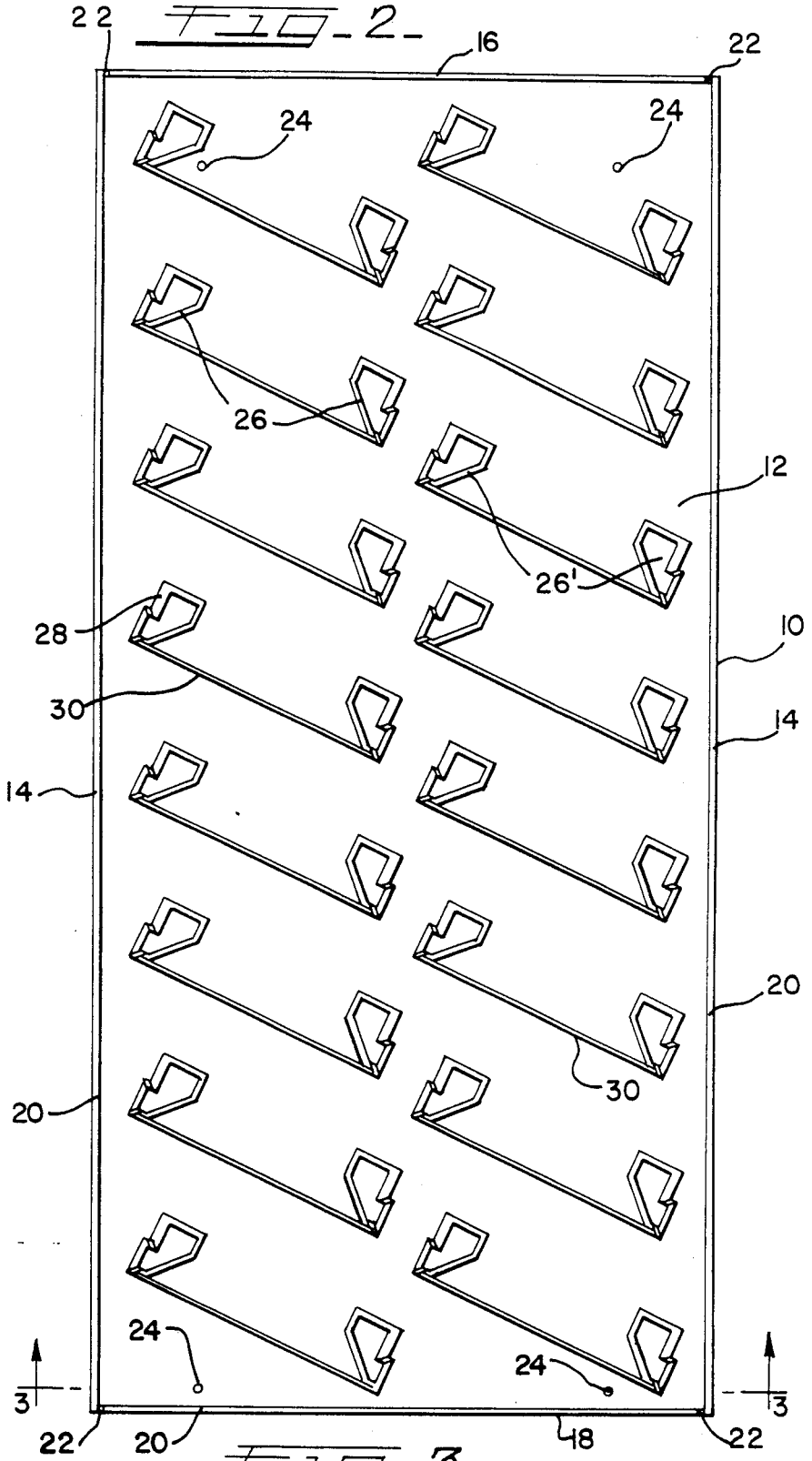
FIG. 2 is a front view of one embodiment of an eyeglass display panel of the present invention.

FIG. 2 discloses in greater detail one of the vertical display panels 10 illustrated in FIG. 1. In a preferred embodiment of the present invention, panel 10 comprises a vertical, generally rectangular panel having a planar display surface 12, vertical sides 14, a topside 16 and a bottom side 18. As disclosed in both FIGS. 2 and 3, each of vertical sides 14 and top and bottom sides 16 and 18, respectively, are bordered by a ridge 20 to enhance the visual appearance of panel 10 and facilitate abutment of panel 20 in creating multi-panel displays. Preferably, ridges 20 on the topside 16 and bottom side 18 of panel 10 are slightly shorter than the overall lengths of topside 16 and bottom side 18 thereby defining slots 22. Both slots 22 and apertures 24 facilitate wall mounting or use of panels 10 in multiple panel display configurations. Apertures 24 penetrate from a front side to a back side of panel 10.

Collectively arranged on display surface 12 of panel 10 are a plurality of aligned pairs of eyeglass holding members 26. In order to maximize the number of eyeglasses carried on panel 10, pairs of holding members 26 are selectively angled and staggered relative to vertically adjacent pairs of holding members 26 preferably in the manner disclosed in FIG. 2. From a space maximization and merchandising standpoint, pairs of holding members 26 are preferably positioned on display panel 12 at angles ranging from 20° to 35° degrees from the horizontal. Lesser angling outside of this range may require widening of panels 10 or greater angling could cause consumer viewing of displayed eyeglasses to be made difficult.

In the preferred embodiment of the present invention, holding members 26 are integrally formed with panel 10 such that panel 10 and holding members 26 are a one-piece unit, preferably injection molded from translucent, high impact polystyrene plastic. Hence, display panels 10 may be created with only one aligned pair of holding members 26 for use in point of purchase or countertop displays or may be formed with a plurality of aligned pairs of holding members 26 to create panels 10 as disclosed in FIG. 2 for wall mount use or multiple panel configurations as disclosed in FIG. 1.

In order to integrally form holding members 26 on panel 10 through injection molding, the holding members 26 must be injection molded from the backside of panel 10. To do so, apertures 28 are necessary in order to effect such formation of holding members 26 on display surface 12 of panel 10. While apertures 28 perform no function in carrying and displaying eyeglasses on panel 10, apertures 28 nonetheless provide a visual contrast to the translucent plastic from which panel 10 is preferably molded.

In addition to apertures 28, an additional feature of injection molding holding members 26 on panel 10 is the use of an alignment rib 30 raised from the surface of display surface 12. Rib 30 is utilized in the injection molding process to assure the proper pairing and alignment of a left holding member 26 and a corresponding right holding member 26 as disclosed in FIG. 2. A further function of ribs 30 are to identify for retailers aligned pairs of the holding members 26 to be employed for carrying eyeglasses on display panel 10.

Figure 4:
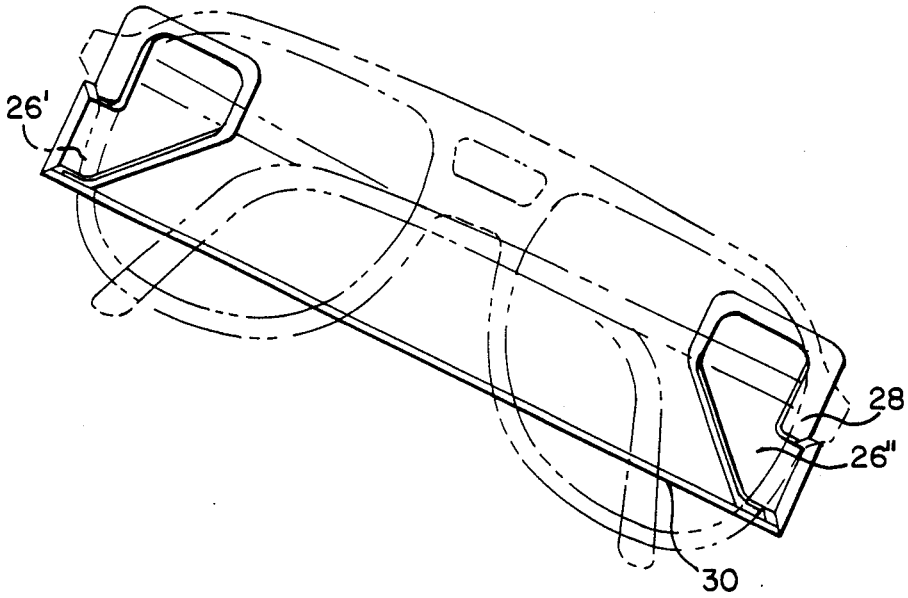
FIG. 4 is an enlargened front view of a preferred pair of eyeglass holding members.

FIG. 4 discloses in greater detail the manner in which eyeglasses (shown in phantom) are supported by a left eyeglass support member 26' and a right eyeglass support member 26", such support members being aligned by rib 30. A more detailed description of the support functions of the uniquely structured members 26' and 26" will be set forth later in greater detail.

Figure 5:
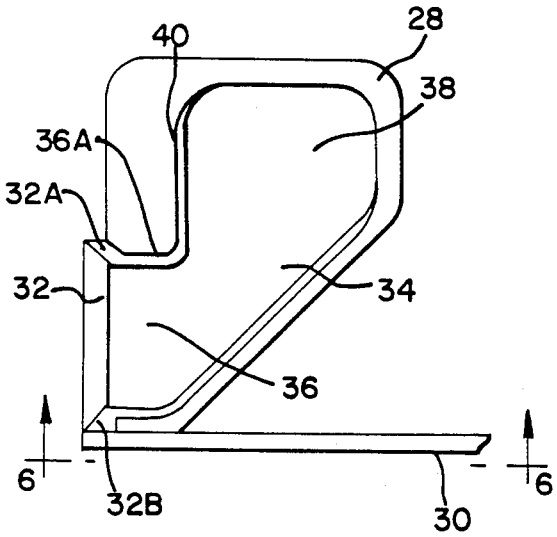
FIG. 5 is a fragmented, enlarged front view of one eyeglass holding member.
Figure 6:
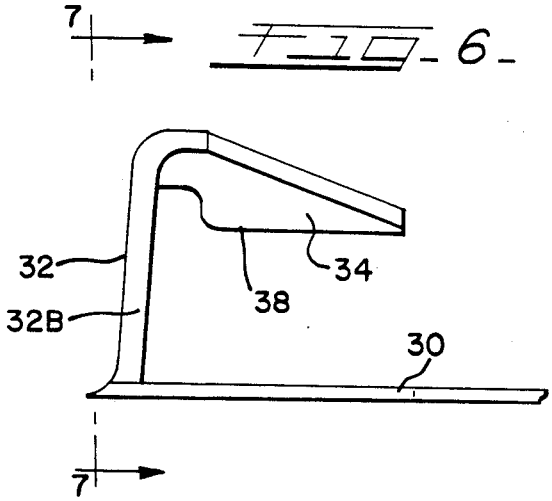
FIG. 6 is a bottom view of the one eyeglass holding member taken along line 6—6 of FIG. 5; and, FIG. 7 is a side view of the one eyeglass holding member taken along line 7—7 of FIG. 6.
Figure 7:
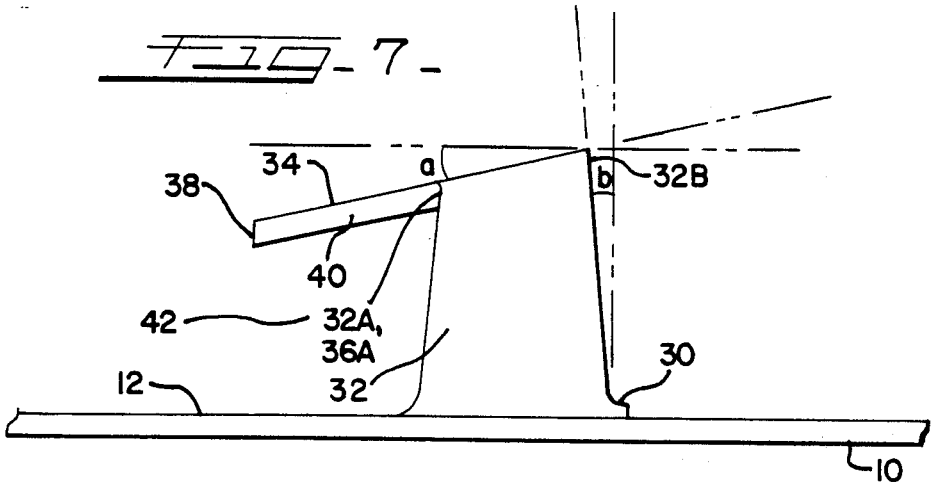

FIGS. 5, 6 and 7 best disclose a preferred embodiment of one eyeglass holding member 26. A base leg 32 is integrally formed with and projects from display surface 12. In a broader embodiment of the present invention, the base leg 32 may be perpendicular to the plane in which display surface 12 lies. In a preferred embodiment disclosed in FIG. 7, base leg 32 angles slightly upward to the topside 16 of panel 10 as described in greater detail below.

Base leg 32 includes one edge 32A generally facing topside 16 of panel 10 and another edge 32B generally facing bottom side 18 of panel 10. Base leg 32 is of sufficient thickness to permit topside edge 32A to perform as an eyeglass supportive surface.

Integrally and continuously joined to base leg 32 is support leg 34. Preferably leg 34 comprises a continuous structure including a supporting segment 36 being directly joined to base leg 32 and an enlargened portion of segment 36 defining an eyeglass retaining segment 38. Supporting segment 36 is of the same or generally similar thickness as base leg 32 thereby forming a top edge 36A which coincides with edqe 32A of base leg 32. Edges 32A and 36A define a primary eyeglass supportive surface of eyeglass support members 26.

In a preferred embodiment of the present invention, retaining segment 38 is continuous with support segment 36 and support leg 34. The thickness of retaining segment 38 may be the same or different from either support segment 36 or base leg 32. Perpendicularly coinciding with the primary eyeglass support surface defined by edges 32A and 36A is an abutment edge 40 on retaining segment 38. The function of abutment edge 40 in retaining the position of an eyeglass on a pair of support members will be explained later in greater detail.

A novel aspect of the eyeglass merchandising display of the present invention is the manner in which support members 26 are pitched on panel 10 slightly upward and angled inward toward display surface 12 as shown in FIG. 7. To insure that displayed eyeglasses are attractively maintained in a position generally parallel to display surface 12, support leg 34 is angularly joined to base leg 32 such that support leg 34 angles inward toward display surface 12 as disclosed in FIG. 7. Specifically, support leg 34 angles downward from bottom side edge 32B toward topside edge 32A of base leg 32. In the embodiment of the present invention disclosed in FIG. 7, declining angle a is defined by support leg 34 and approximates 13° from the vertical. However, it has been determined that support leg 34 may be downwardly pitched toward display surface 12 at any angle ranging from 10° to 25°.

FIG. 7 likewise discloses that base leg 32 is preferably angled upward toward topside 16 of panel 10 in which inclining angle b of FIG. 7 approximates 5°. However, it has been determined that the upward angling of base leg 32 may range between 0°-20°.

Figure 3:
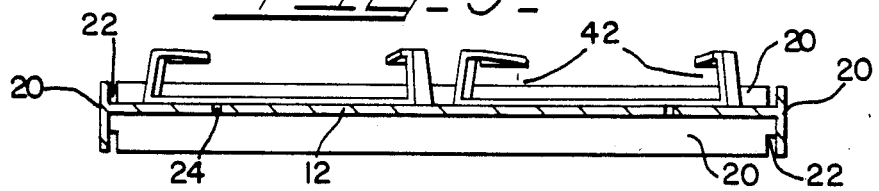
FIG. 3 is a bottom view of the display panel viewed along line 3—3 of FIG. 2.

As disclosed in FIGS. 3 and 7, support leg 34, base leg 32 and panel display surface 12 define an opening 42. Opening 42 is of sufficient dimensions to receive hinge and temple portions of the eyeglass frame. The inward pitching of support leg 34 and upward inclining of base leg 32 shown in FIG. 7 reduces the inner dimensions of opening 42. By so reducing opening 42, eyeglasses are snuggly retained by support members 26 and maintained in a merchandising position generally parallel to display surface 12.

Finally, returning to FIG. 4, a folded pair of eyeglasses (depicted in phantom) may be carried and retained on support members 26 of panel 10 by placing the eyeglasses over each retaining segment 38 such that each retaining segment 38 is positioned between the lenses of the eyeglass and folded portions of the temples and earpieces of the eyeglass frame. Next, the hinge and temple portions of the eyeglass frame after passing through opening 42, are rested upon the primary eyeglass supportive surfaces defined by edges 32A and 36B of legs 32 and 34. The presence of abutment edge 40 on retaining segment 38 and positioning of retaining segment 38 between the eyeglass lens and folded portions of the eyeglass frame earpieces, prevents eyeglasses from sliding off support members 26 and limits the amount of play or lateral sliding on support members 26.

Moreover, the unique inward angling of support leg 34 toward panel 10 and the upward angling of base leg 32, resulting in the overall upward angling of support member 26, causes the eyeglasses to be more snugly carried and supported on support members 26 and assures that the eyeglasses are maintained in a position parallel to display surface 12.

Hence, the unique eyeglass merchandising display of the present invention results in an organized and attractive display of eyeglasses which can be easily removed from the display and replaced on the display by consumers. Unlike prior art eyeglass merchandising displays which require consumers to unfold the eyeglasses and pass the earpieces and temples through apertures in the display panel, the present invention merely requires the consumer to refold the eyeglasses replacing them over retaining segment 38, resting on edges 32A and 36A and abutting against abutment edge 40.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

I claim:

1. A merchandising display for displaying folded eyeglasses comprising:

a vertical panel having a planar display surface, the panel having a topside and a bottom side;

at least two aligned eyeglass holding members being integrally formed on the display surface, each holding member including, a base leg joined to the display surface, the base leg having one edge facing the topside of the panel and another edge facing the bottom end of the panel, a support leg angularly joined to the base leg, the support leg angles downward from the bottom side edge of the base leg to the topside edge of the base leg so that the support leg angles inward toward the display surface, the support leg including a support edge coplanar with and generally perpendicular to the topside edge of the base leg to define an eyeglass support surface, the support leg also having an abutment edge perpendicularly disposed to the eyeglass support surface, such that folded eyeglasses may be supported on the display by placing on the eyeglass support surface hinge and temple portions of the eyeglass, the abutment edge limiting lateral movement of the eyeglasses on the support members.

2. The eyeglass display described in claim 1 wherein said panel includes a plurality of aligned pairs of holding members.

3. The eyeglass display described in claim 2 in which the pairs of support members are selectively angularly oriented on the panel display surface maximizing the style and quantity of eyeglasses displayed which minimizes the overall dimensions of the panel.

4. The eyeglass display described in claim 1 wherein said base leg upwardly angles toward the topside of the panel.

* * * * *